US008087111B2

(12) United States Patent
Paris

(10) Patent No.: US 8,087,111 B2
(45) Date of Patent: Jan. 3, 2012

(54) ENCASEMENT FOR A MATTRESS

(76) Inventor: Armando Paris, Vancouver (CA)

( * ) Notice: Subject to any disclaimer, the term of this patent is extended or adjusted under 35 U.S.C. 154(b) by 0 days.

(21) Appl. No.: 12/986,044

(22) Filed: Jan. 6, 2011

(65) Prior Publication Data

US 2011/0162140 A1 Jul. 7, 2011

Related U.S. Application Data

(60) Provisional application No. 61/292,814, filed on Jan. 6, 2010.

(51) Int. Cl.
*A47G 9/04* (2006.01)
*A47C 31/00* (2006.01)

(52) U.S. Cl. ..... 5/499; 5/738; 5/484; 5/699

(58) Field of Classification Search ..... 5/499, 737, 5/738, 699, 484, 939
See application file for complete search history.

(56) References Cited

U.S. PATENT DOCUMENTS 1,976,698 A * 10/1934 Gihon, III ..... 190/102
2,400,731 A * 5/1946 Armstrong ..... 5/500
2,689,961 A * 9/1954 Lieberthal ..... 5/486
3,027,573 A * 4/1962 Bell, Jr. ..... 5/738
3,241,161 A * 3/1966 Dashosh ..... 5/501
3,292,748 A * 12/1966 Rifkin ..... 190/119
3,530,516 A * 9/1970 Marquette ..... 5/486
4,164,797 A * 8/1979 Golembeck ..... 5/738
4,397,378 A * 8/1983 Lee ..... 190/119
4,445,241 A * 5/1984 Ender et al. ..... 5/652.1
5,056,603 A * 10/1991 Parkinson ..... 169/48
5,321,861 A * 6/1994 Dancey et al. ..... 5/482
5,910,081 A * 6/1999 Graham ..... 5/699
5,966,759 A * 10/1999 Sanders et al. ..... 5/499
6,363,553 B1 * 4/2002 Baumgartel et al. ..... 5/482
6,431,334 B1 * 8/2002 Lin ..... 190/120
6,823,543 B2 * 11/2004 Ghanem ..... 5/496
6,948,207 B2 * 9/2005 Daly ..... 5/738
7,552,489 B2 * 6/2009 Bell et al. ..... 5/499
2004/0064889 A1 * 4/2004 Ghanem ..... 5/482
2008/0222808 A1 * 9/2008 Bell et al. ..... 5/500
2009/0049608 A1 * 2/2009 Bell et al. ..... 5/499
2009/0271926 A1 * 11/2009 Bell et al. ..... 5/499
2010/0281614 A1 * 11/2010 Park ..... 5/484
2011/0010856 A1 * 1/2011 Bell et al. ..... 5/499
2011/0041247 A1 * 2/2011 Moon ..... 5/490
2011/0099714 A1 * 5/2011 Svoboda ..... 5/499
2011/0162140 A1 * 7/2011 Paris ..... 5/499

* cited by examiner

*Primary Examiner* — Robert G Santos
(74) *Attorney, Agent, or Firm* — Fasken Martineau Dumoulin; Susan Ben-Oliel

(57) ABSTRACT

An encasement includes a cover, an opening provided at an end of the cover, a closure mechanism coupled to the cover for selectively closing the opening and an encasement seal provided at an end of the opening, the encasement seal including a base coupled to the cover and a flap, the flap being movable between an open position and a closed position; wherein the encasement seal provides an outer cover for a portion of the closure mechanism at the end.

6 Claims, 6 Drawing Sheets

ENCASEMENT FOR A MATTRESS

FIELD OF THE INVENTION

The present invention relates to encasements around mattresses, pillows, duvets and the like.

BACKGROUND OF THE INVENTION

All types of insects can be found within hotel rooms, motel rooms, cruise ships and in one's own home. The common bed bug is a particularly irritating insect because it attacks humans for blood. When a human body lies down at night, the bed bugs come out from the box spring and mattress to feed on human blood and then return back into their homes to lay eggs and reproduce.

Many doctors of entomology agree that the best way to eliminate bed bugs is by encasing the entire mattress and box spring with a fabric encasement so that the bed bugs can not enter or escape. By encasing the mattress or box spring with fabric and closing the zipper mechanism, bed bugs are restricted from reaching the human on the mattress and/or using the box spring to rest and lay their eggs.

Many different types of mattress encasements are available, such as the encasement 1, which is shown in FIG. 1. The encasement 1 includes an opening 2 that is closable by a zipper. Mattress encasements such as these are not ideal because the zipper closure may be unzipped if the mattress encasement moves around, if the zipper is accidentally moved by a child or while changing the sheets. As such, end 3 of the zipper is often an access point for bed bugs. An improved mattress encasement is therefore desirable.

SUMMARY OF THE INVENTION

In one aspect there provided an encasement comprising: a cover; an opening provided at an end of the cover; a closure mechanism coupled to the cover, the closure mechanism for selectively closing the opening; and an encasement seal provided at an end of the opening, the encasement seal comprising a base coupled to the cover and a flap, the flap being movable between an open position and a closed position; wherein the encasement seal provides an outer cover for a portion of the closure mechanism at the end.

FIGURES

The following figures set forth embodiments of the invention in which like reference numerals denote like parts. Embodiments of the invention are illustrated by way of example and not by way of limitation in the accompanying figures.

DETAILED DESCRIPTION OF EMBODIMENTS

Figure 1:
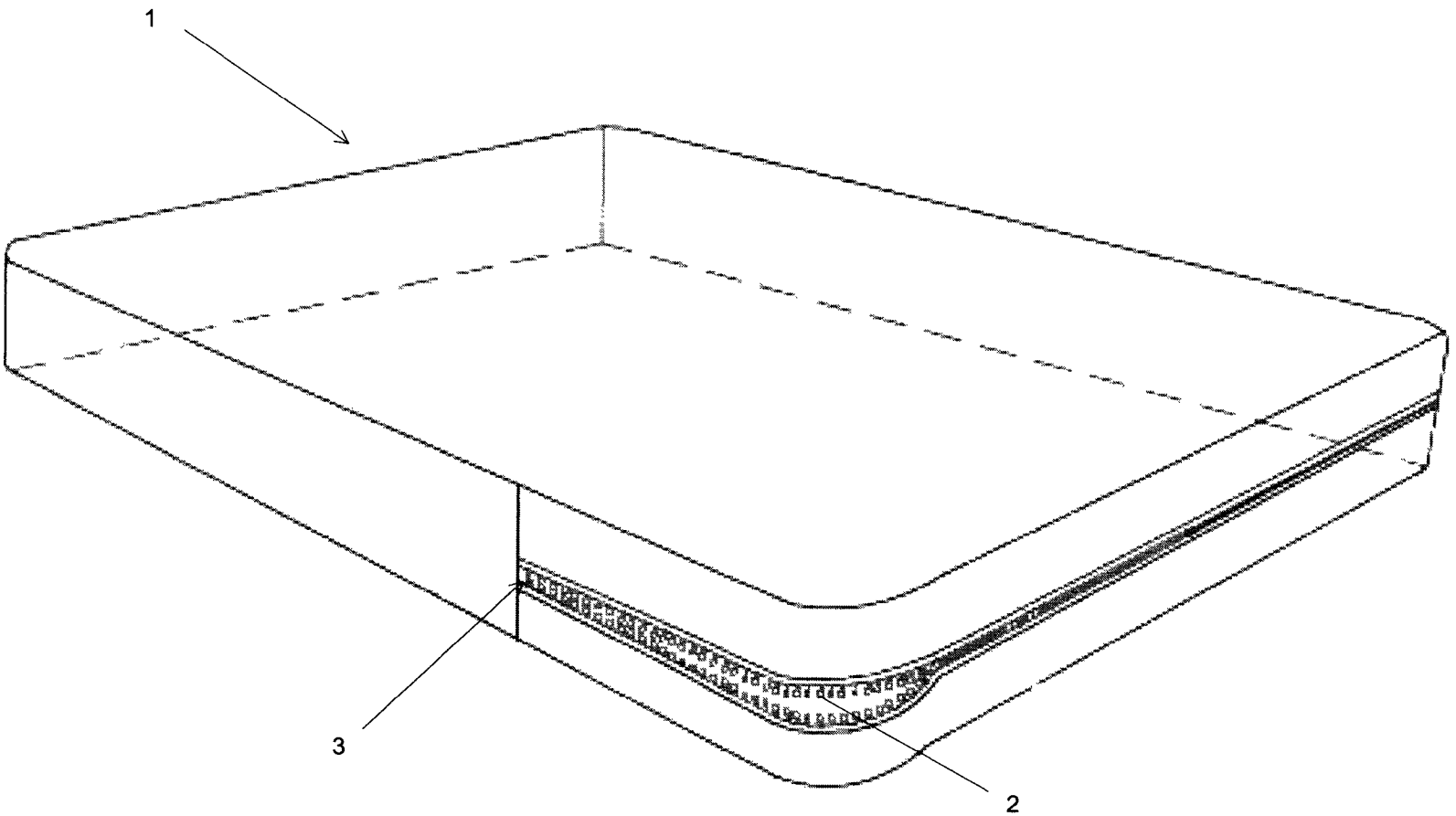
FIG. 1 PRIOR ART
FIG. 1 is an isometric view of a prior art encasement.
Figure 2:
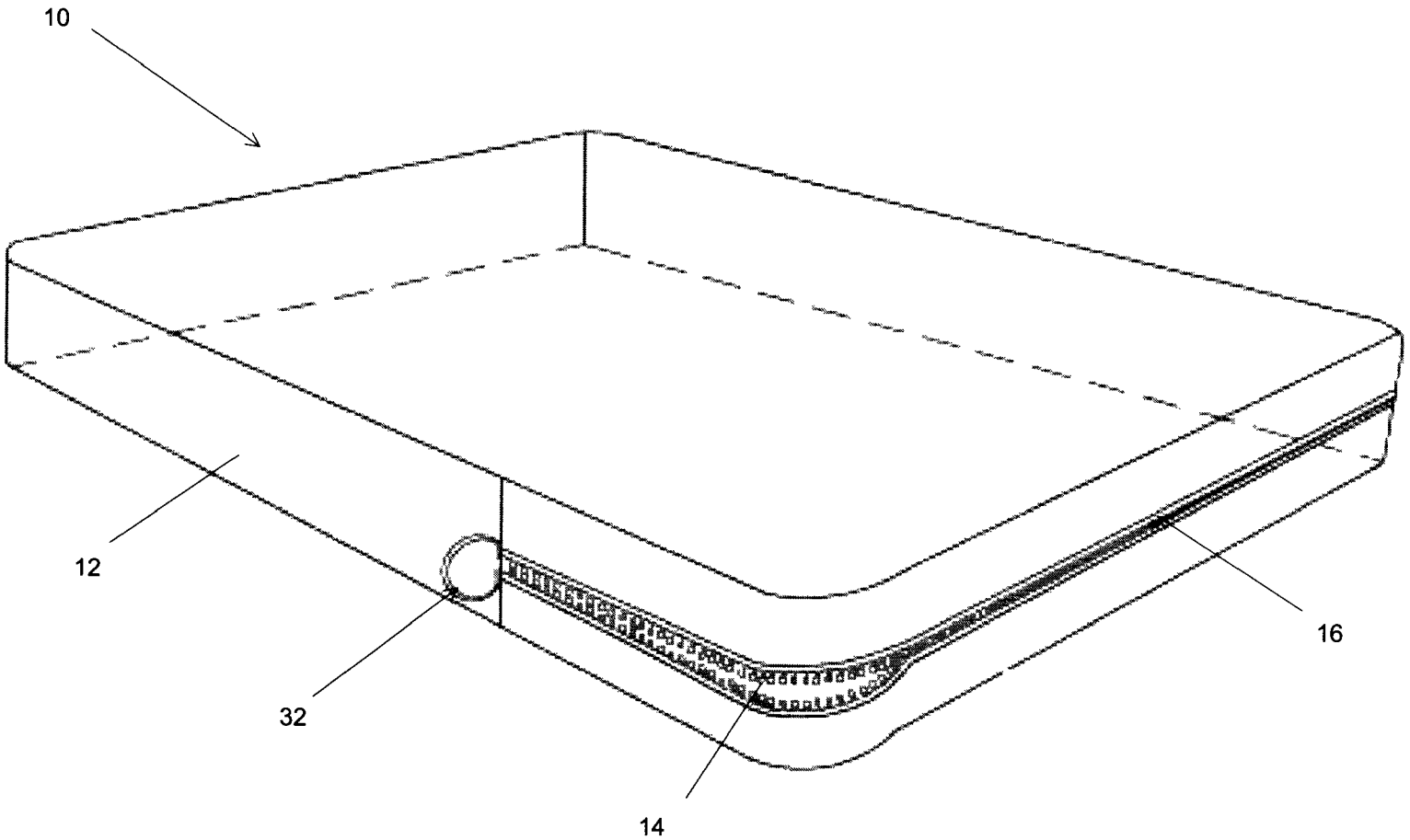
FIG. 2 is an isometric view of an encasement according to an embodiment of the present invention.

Referring to FIG. 2, an encasement 10 includes a cover 12 having a size and shape for receiving a mattress (not shown). An opening 14 is provided at one end of the cover 12 to allow a mattress to be inserted into the encasement 10. The opening 14 generally extends fully along an openable end 16 of the cover 12 and part way along the two adjacent sides, as shown.

Figure 3:
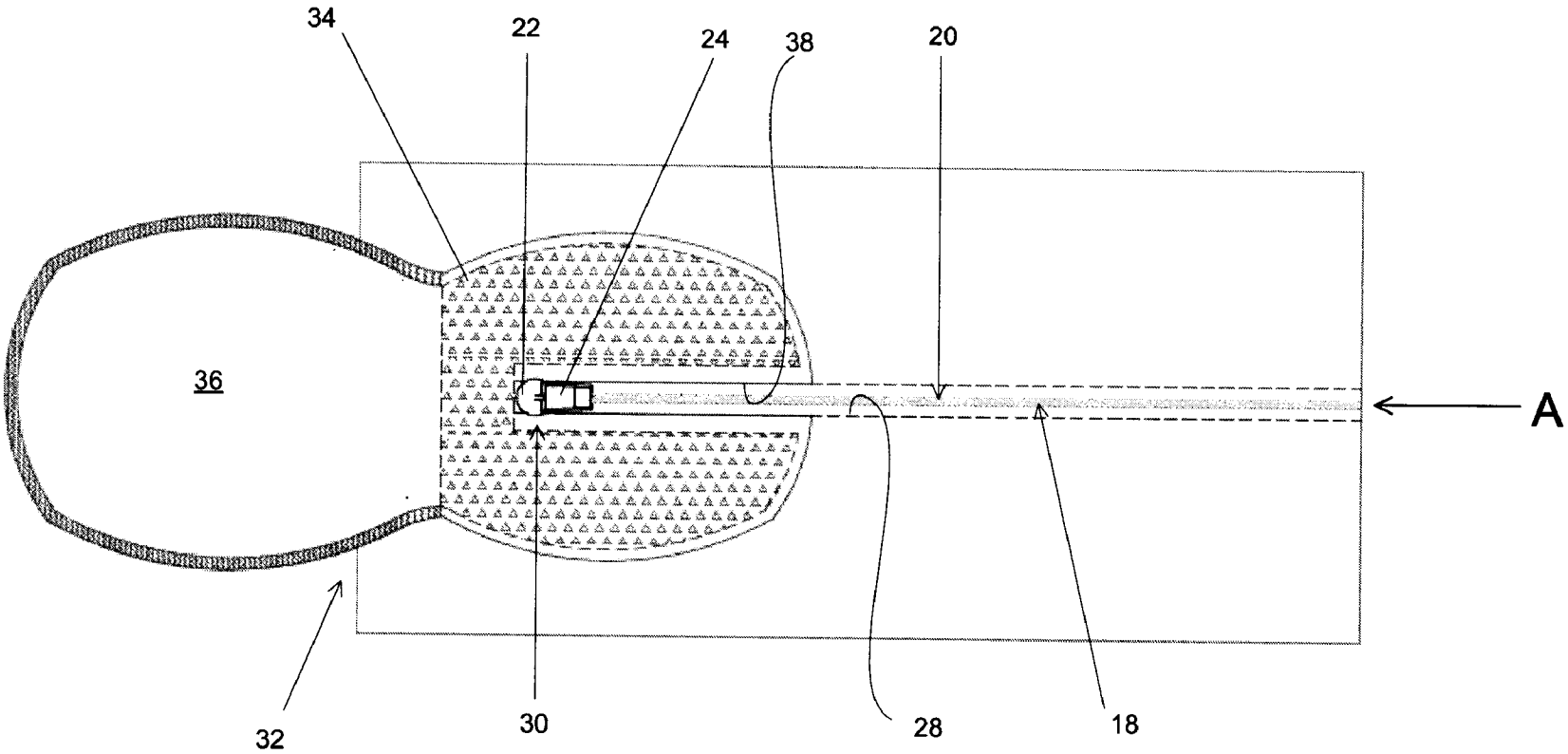
FIG. 3 is a top view of a portion of the encasement of FIG. 2 showing an encasement seal in an open position.
Figure 4:
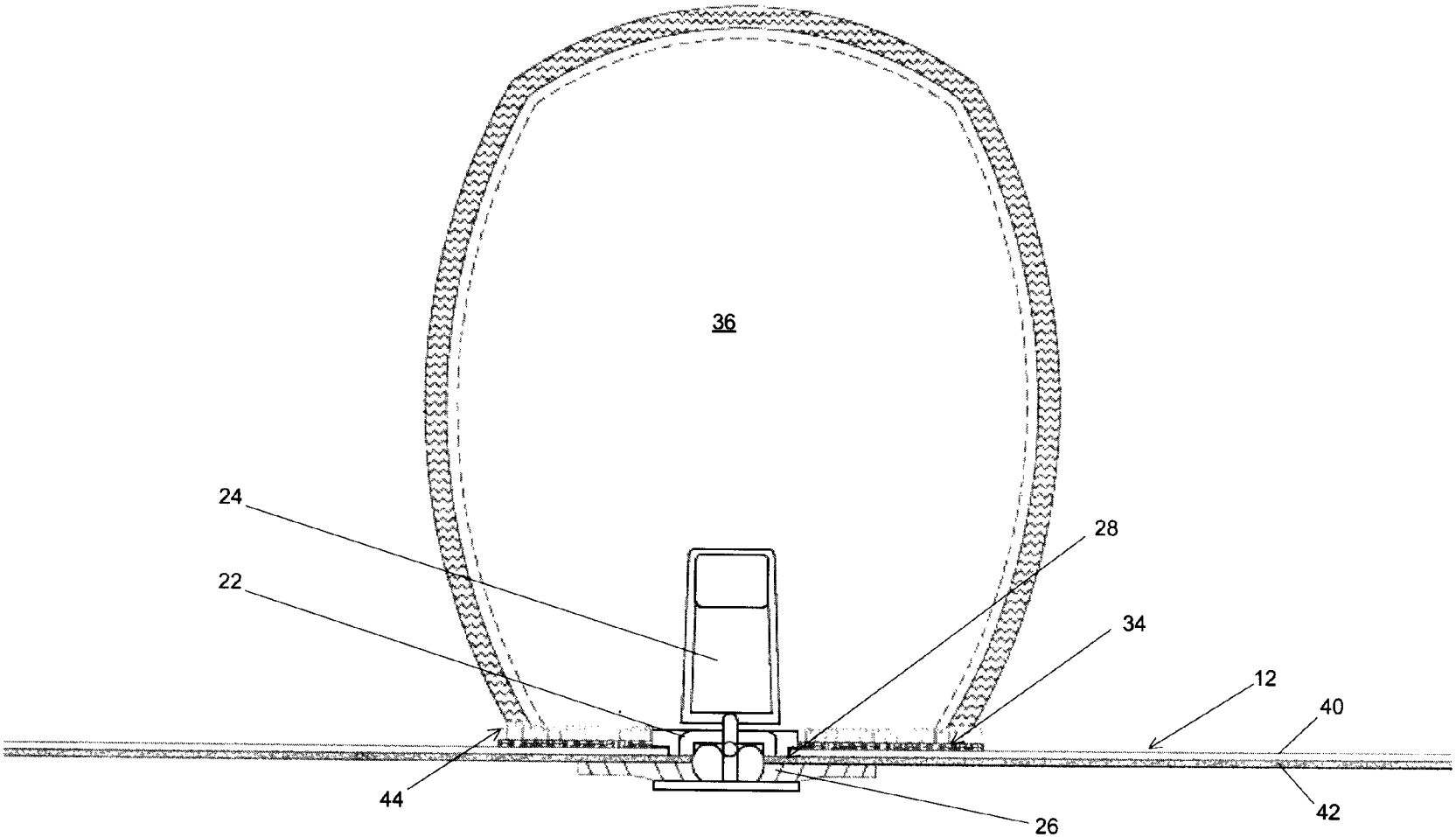
FIG. 4 is a view on A of FIG. 3.

Referring to FIGS. 3 and 4, the cover 12 includes an outer layer 40 and an inner layer 42. The outer layer 40 may be cotton or another suitable bedding fabric, such as polyester or a polyester-cotton blend, for example. The inner layer 42 is a waterproof membrane that is adhered to the outer layer 40. The inner layer 42 is applied using a spraying process that coats the outer layer 40, however, other suitable methods for applying the coating may alternatively be employed. The inner layer 42 may be made of polyurethane or another suitable material that allows the cover to be generally impenetrable by bed bugs.

A closure mechanism 18 is provided to selectively allow access to the mattress through the opening 14. In one embodiment, the closure mechanism 18 is a zipper including teeth 20, a slider 22 for joining the teeth and a pull tab 24 for moving the slider 22. The teeth are coupled to a tape 26, which is sewn into free edges 28 of the fabric at the openable end 16. The slider 22 is movable between a start location, in which the opening 14 is open and an end location 30, in which the opening 14 is closed. Although it is not visible from the figures and is often not visible to the human eye, a gap is provided at the end location 30. Other types of suitable closure mechanisms may alternatively be used.

Figure 5:
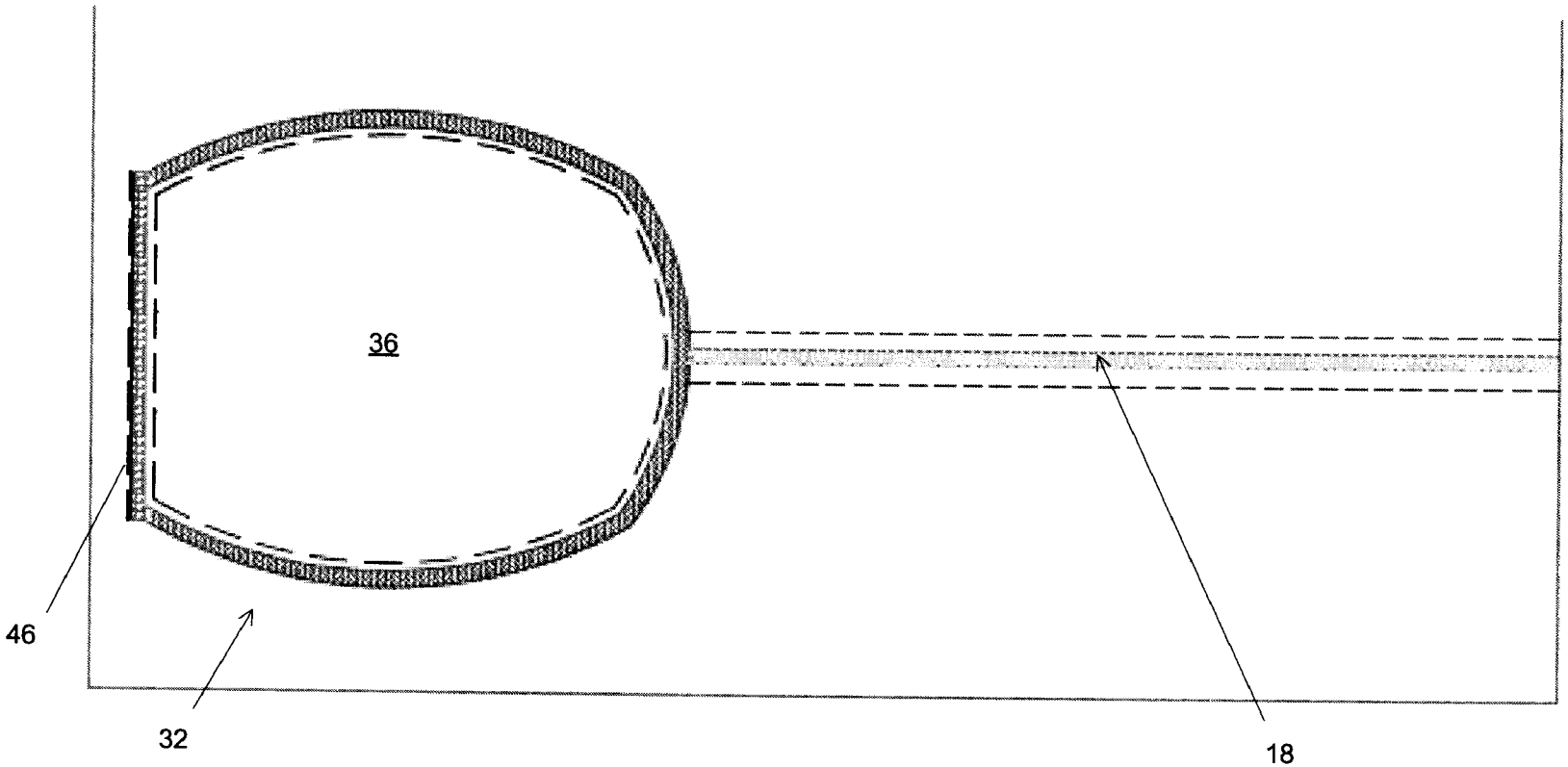
FIG. 5 is top view of a portion of the encasement of FIG. 2 showing the encasement seal in a closed position.
Figure 6:
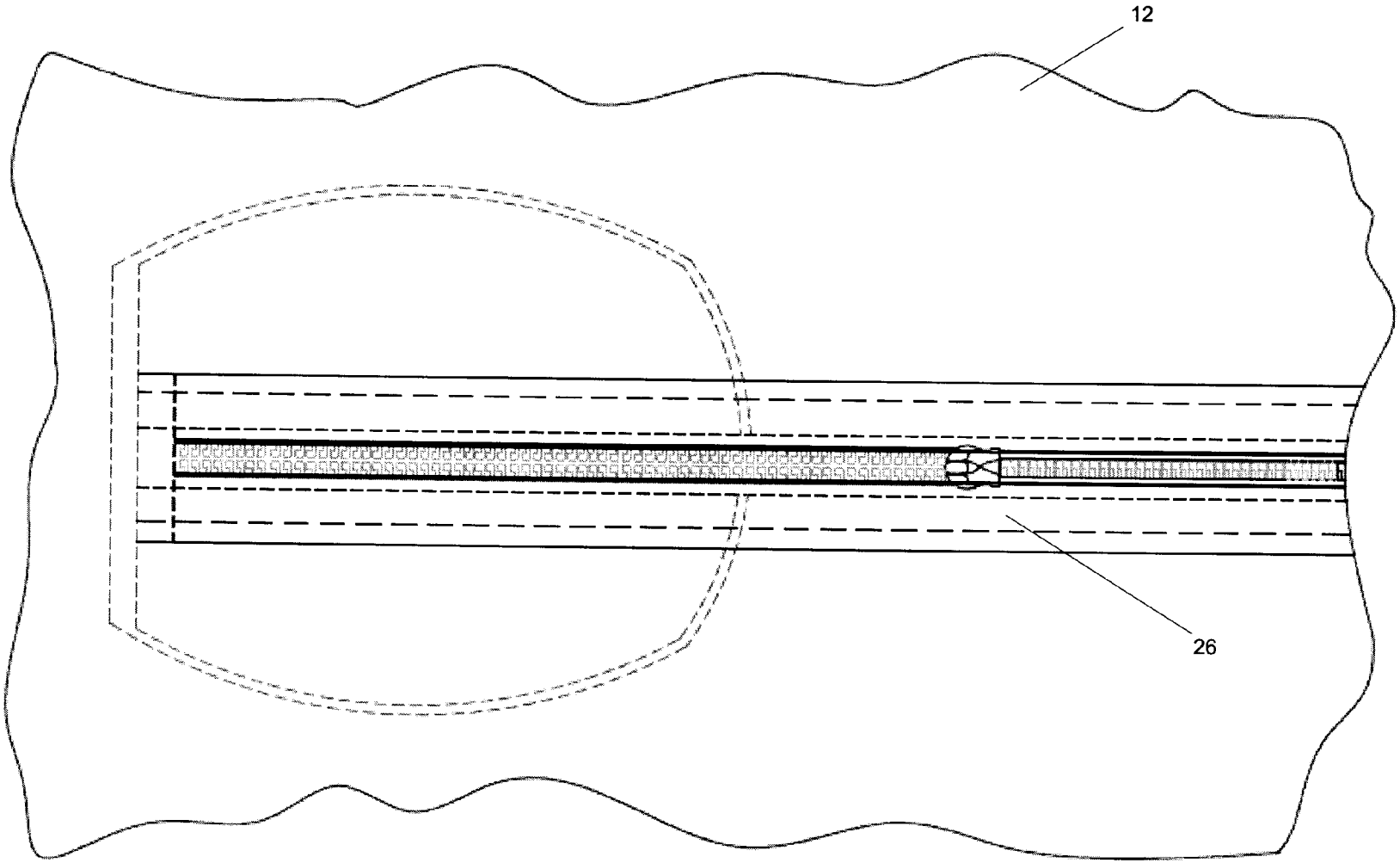
FIG. 6 is a bottom view of FIG. 3.

An encasement seal 32 is provided adjacent to the end location 30. The encasement seal 32 includes a base 34, which is coupled to the cover 12, and a flap 36. The base 34 includes hooks 44 of a hook and loop fastener, such as Velcro™, for example, and the flap 36 includes loops of the hook and loop fastener. The flap 36 selectively engages the base 34 and is movable between an open position, which is shown in FIG. 3, and a closed position, which is shown in FIG. 5. In the closed position, the hooks 44 mate with the loops to provide an outer cover and close the gap at the end location 30. As will be appreciated by a person skilled in the art, the hooks may alternatively be located on the flap 36 and the loops may be located on the base 34.

The base 34 includes a cutout 38 that is sized to allow the zipper 18 to move freely to the end location 30. The base 34 is coupled to the cover 12 by sewing or another suitable means such as an adhesive, for example. The flap 36 is joined to the base 34 at a joint 46 by sewing or another suitable means. The flap 36 is pivotable about the joint 46 to open and close the encasement seal 32.

In one embodiment, the flap 36 is coupled to the base 34 prior to the encasement seal 32 being coupled to the cover 12. In another embodiment, the base 34 is first coupled to the cover 12 and the flap 36 is then attached to the base 34 and cover 12 to provide the encasement seal 32.

In operation, the mattress is received in the encasement 10 through opening 14. The zipper 18 is then moved to a closed position, as shown in FIG. 3. In this position, the opening 14 is closed, however, bed bugs may still access the mattress through the gap at the end location 30. The flap 36 of the encasement seal 32 is then closed to cover the gap and generally prevent ingress and egress of bed bugs therethrough.

In one embodiment, the encasement seal 32 is coupled to an encasement at the time of manufacture. In another embodiment, the encasement seal 32 coupled to a previously manufactured encasement. In other words, it is fully contemplated within the scope of the present invention that encasement seal 32 may be retrofitted onto existing encasements in order to enhance barrier function.

In still another embodiment, the pull tab 24 of the zipper 18 is covered with fabric and the fabric-covered pull tab is nested in a pull tab-receiving pocket that is provided at the end location 30. The fabric covered pull tab is provided in combination with the encasement seal 32. In this embodiment, the pull tab-receiving pocket reduces the size of the gap prior to the closing of the encasement seal 32, which may increase the effectiveness of the encasement seal 32.

The encasement 10 including the encasement seal generally restricts bed bugs from entering the encasement 10 or exiting therefrom at the zipper end location 30. An advantage of the encasement seal 32 is that movement of the zipper 18 is restricted so that the zipper 18 will not accidentally open over time and allow access to the encasement 10.

Another advantage of the encasement is that because the encasement seal 32 is provided outside of the cover 12, it does not interfere with opening and closing of the zipper 18. The cutout 38 of the base 34 frames the zipper 18 near the end location 30 to allow the zipper 18 to move freely.

Still another advantage of the encasement 10 is that the encasement seal 32 has a low profile so that standard sheet sets have no problem sliding over the encasement seal 32. Further, unlike foam components or hooks that may break or degrade over time, the hook and loop fastener of the encasement seal 32 will remain functional over a long period of time.

Another advantage is that the flap 36 provides a good location for printing information about the encasement cover, such as encasement cover size, for example. In large hotels, this feature allows house keeping staff to quickly locate encasement covers of a particular size.

It will be appreciated by a person skilled in the art that although the encasement 10 has been described as receiving a mattress, the encasement 10 may alternatively receive a box spring. Further, the encasement 10 may be provided in different sizes and shapes for use with mattresses, box springs, couch cushions, chair cushions, pillows and duvets, for example, or any stuffed or filled article (whether stuffed or filled by natural or man-made materials).

Specific embodiments have been shown and described herein. However, modifications and variations may occur to those skilled in the art. All such modifications and variations are believed to be within the scope and sphere of the present invention.

The invention claimed is:

1. An encasement comprising:

a cover for enclosing a stuffed/filled product, such product being susceptible to bed-bug infestation;

an opening provided at an end of said cover;

a closure mechanism coupled to said cover, said closure mechanism for selectively closing said opening; and an encasement seal provided at an end of said opening, said encasement seal comprising a base coupled to said cover and a flap, said flap being movable between an open position and a closed position;

wherein said encasement seal provides an outer cover for a portion of said closure mechanism at said end; and wherein said encasement seal comprises fastening means on facing sides of said base and said flap to couple said flap to said base and wherein said fastening means substantially completely covers the entire facing sides of both the base and the flap to provide a substantially bed bug impermeable barrier when said flap is moved to a closed position.

2. The encasement as claimed in claim 1, wherein said fastening means is a hook and loop fastener.

3. The encasement as claimed in claim 1, wherein said cover is sized to receive a mattress or a box spring.

4. The encasement as claimed in claim 1, wherein said cover includes a waterproof membrane.

5. The encasement as claimed in claim 1 wherein said closure mechanism comprises a zipper with a pull-tab, and wherein said pull-tab is provided with a pocket to receive and secure the pull-tab when the zipper is in the closed position.

6. The encasement as claimed in claim 1 wherein the base and flap match in size and are substantially oval in shape.

* * * * *